US006725466B2

(12) United States Patent
Hochmuth

(10) Patent No.: US 6,725,466 B2
(45) Date of Patent: Apr. 27, 2004

(54) REINFORCING STRIP FOR A GOALKEEPER'S GLOVE

(76) Inventor: Peter Hochmuth, Weissenburger Strasse 19, D-91757 Treuchtligen (DE)

( * ) Notice: Subject to any disclaimer, the term of this patent is extended or adjusted under 35 U.S.C. 154(b) by 0 days.

(21) Appl. No.: 10/132,629

(22) Filed: Apr. 24, 2002

(65) Prior Publication Data

US 2002/0184696 A1 Dec. 12, 2002

(30) Foreign Application Priority Data

Apr. 25, 2001 (DE) ..... 201 07 098 U

(51) Int. Cl.[7] ..... A41D 19/00
(52) U.S. Cl. ..... 2/161.1
(58) Field of Search ..... 2/16, 20, 161.1, 2/160, 161.6, 161.8, 169

(56) References Cited

U.S. PATENT DOCUMENTS

| | | | | |
|---|---|---|---|---|
| 5,274,846 A | * | 1/1994 | Kolsky | 2/460 |
| 6,202,217 B1 | * | 3/2001 | Karall | 2/161.6 |
| 6,557,177 B2 | * | 5/2003 | Hochmuth | 2/159 |

FOREIGN PATENT DOCUMENTS

| | | |
|---|---|---|
| DE | 9910799 | 8/2000 |
| EP | 1074194 | 2/2001 |
| WO | 0100052 | 1/2001 |
| WO | 2076249 | 10/2002 |

* cited by examiner

*Primary Examiner*—Katherine Moran
(74) *Attorney, Agent, or Firm*—Sidley Austin Brown & Wood, LLP

(57) ABSTRACT

A reinforcing strip for a goalkeeper's glove and including a plurality of compression-proof link members supported on a carrier band in a string-like manner, with each two adjacent link members forming a pivot connection with each other and having stop surfaces facing each other, extending transverse to the carrier band, and abutting each other in a stretched position of the reinforcing strip, with each of the link members having a cavity provided in a middle region of the link member and open at the upper surface of the link member, and a flat closed bottom surface glued to the carrier band and with two side regions located on opposite sides of the middle region and having a height gradually diminishing toward a respective outer edge of a respective link member, and with each of the side regions having a cavity open at the upper surface.

9 Claims, 2 Drawing Sheets

Fig. 1
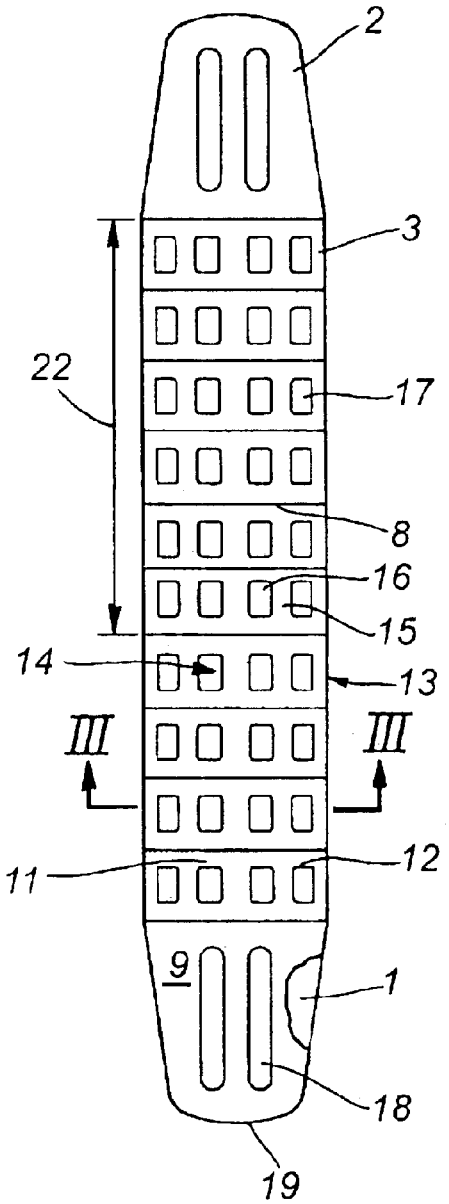
Fig. 2
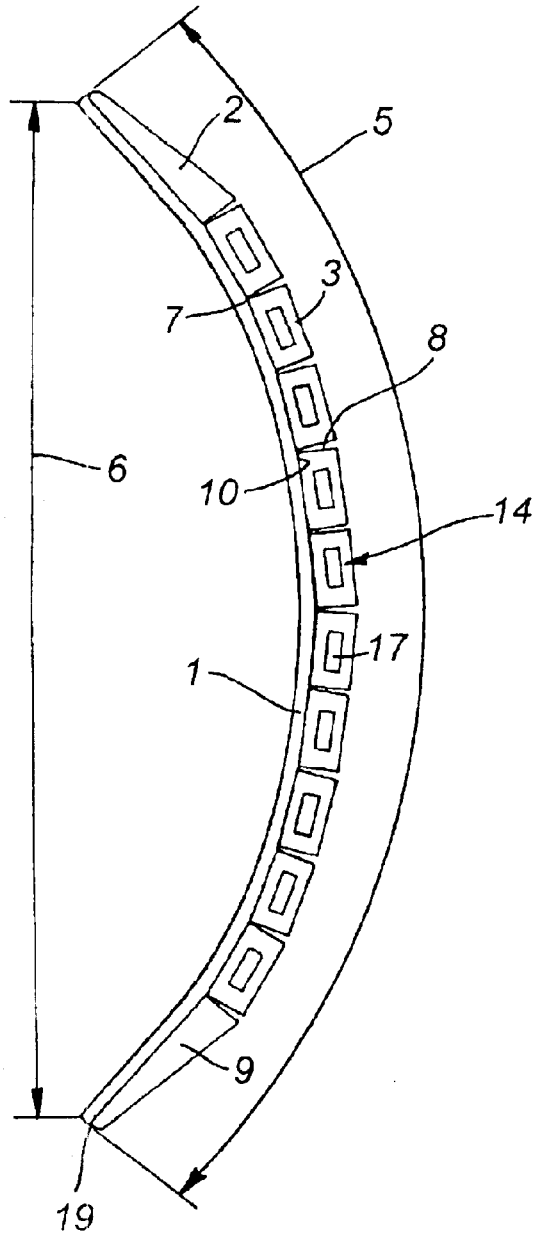
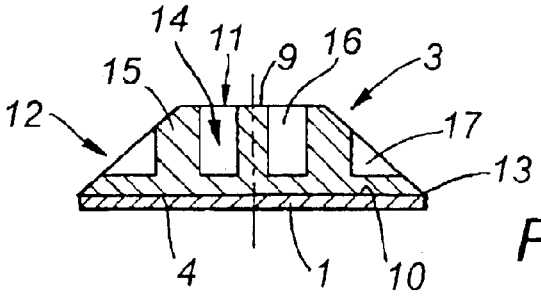
Fig. 3

Fig. 4
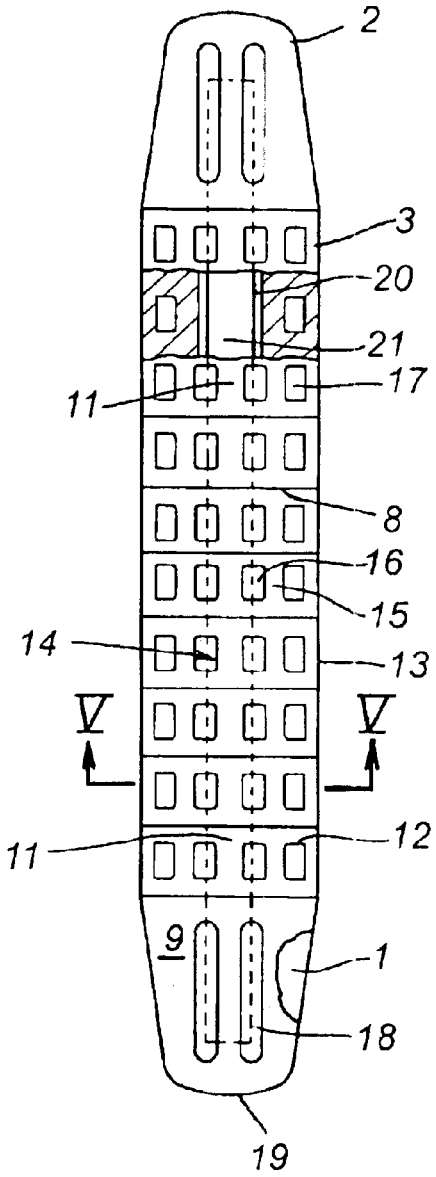
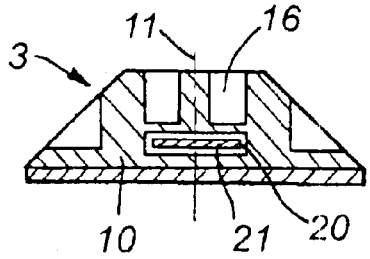
Fig. 5

REINFORCING STRIP FOR A GOALKEEPER'S GLOVE

BACKGROUND OF THE INVENTION

1. Field of the Invention

The present invention relates to a reinforcing strip for a goalkeeper's glove and including a flexible, substantially high-tensile carrier band, and a plurality of compression-proof link members supported on the carrier band in a string-like manner, with each two adjacent link members forming a pivot connection with each other and having stop surfaces facing each other, extending transverse to the carrier band, and abutting each other in a stretched position of the reinforcing strip, with each of the link members having an upper surface remote from the carrier band, a cavity provided in a middle region of the link member, and a bottom glued to the carrier band with formation of glue layer therebetween, and with each link member having two side regions located on opposite sides of the middle region, with a height diminishing toward a respective outer edge of a respective link member.

2. Description of the Prior Art

A glove, which covers a hand and wrist joint, should not inhibit the hand and joint movements to a most possible extent. Be-verally, the wrist join permits a pivotal movement of the hand forward but limits the backward pivotal movement. If the limitation of the backward movement is overcome by force, the hand and wrist joint can be broken. With a completely pulled-on glove, there exists a danger that a large force would be applied to the hand, which is covered with the glove. This force would overcome the natural limitation of the backward movement of the hand. Such a danger particularly exists when the hand is covered by a goalkeeper's glove or a workman's glove. To prevent this danger, a reinforcing strip is provided on the upper side of a glove which extends up to the region associated with the wrist joint. The reinforcing strip permits the forward movement of the hand but is rigid enough to prevent a significant hand backward movement, preventing the breaking of the wrist joint or any other part of a hand upon application of a significant force to the hand.

German Patent DE 199 10 799C1 discloses a glove-reinforcing strip of the type described above, in which the cavity in each of the link members opens toward the bottom, so that the bottom surface is not completely closed. As a result, only a portion of the bottom surface is glued to the carrier band. With a predetermined width of the reinforcing strip, the forces acting between the carrier band and the link members should be absorbed by the glued portion of the bottom surface. This is associated with additional expenses necessary to provide a more stronger gluing.

The provision of a cavity in the link member is necessary for reducing the weight of the link member. Each link member forms, transverse to the reinforcing strip, a middle rectangular elevation in which only one cavity is formed, with two foot members adjoining the elevation of its opposite sides and having a height which is smaller than that of the elevation. In this way, a step is formed between the elevation and each of the foot members. Such shape reduces the weight of the link member but is associated with sharp edges and corners which, upon the use of the glove, can result in an injury of the glove wearer (the goalkeeper) and adversely affect the function of the reinforcing strip.

Accordingly, an object of the present invention is to provide a reinforcing strip of the type described above but having a sufficiently large gluing area between the carrier band and the link members, and link members with a rounded upper surface shape, together with a noticeably reduced weight due to the provision of cavities in the link members.

SUMMARY OF THE INVENTION

This and other objects of the present invention, which will become apparent hereinafter, are achieved by provided in a reinforcing strip in which each of the link members has a cavity provided in the middle region of the link member and opened at the upper surface, and a flat closed bottom surface glued to carrier member with formation of a glue layer there between, and in which each link member ahs two side regions located on opposite sides of the middle region, with a height of each of the side region gradually diminishing toward a respective outer edge of a respective link member, with each of the side regions having a cavity opened at the upper surface.

Due to the cavity being open at the upper surface and the height of the side region being gradually reduced, the weight of the reinforcing strip according to the present invention is noticeably reduced in comparison with the prior art reinforcing strip. However, this weight reduction does not lead to a reduced glued area at the predetermined width of the strip, nor does it lead to sharp edges and corners of the upper surface profile. Rather, the link member is glued to the carrier band over its entire bottom surface, and the link member has a streamlined upper profile.

As a rule, the width of a link member, which is associated with the width of a respective section of the reinforcing strip, is larger than the length of the link member associated with the length of the respective section of the reinforcing strip. It is particularly preferable and advantageous when there is provided in the cavity a longitudinally extending web that divides the cavity into two sections. This web supports the opposite stop surfaces of the link member or wall regions of the link member that form the stop surfaces and limit the respective cavity portion. The link member can have two or three of such longitudinally extending webs.

The middle region of the link member, e.g., can have a plannar upper surface extending parallel to the carrier band, with the side regions likewise having plannar but inclined outer surfaces. In another embodiment of a reinforcing strip according to the present invention, the middle region and the two side region form a continuous arcuate upper surface extending from one outer edge to another outer edge. As a rule, a link member has a width equal to that of the carrier band. However, a link member can have a width greater than that of the carrier band, so that the link member has marginal strips on opposite sides of the carrier band.

As a rule, the link member is formed of a plastic material. In this case, under "gluing" of the carrier band with a link member, a fusion of the bottom surface of the link member with the carrier member is understood.

The present invention also relates to a glove, e.g., a goalkeeper's gloves into which the reinforcing strip according to the present invention is embedded. As a rule the reinforcing strip is embedded in a back section or an outer section of the glove, extending between inner and outer points of the outer hand section of the glove.

A cavity is formed as a recess which is limited by the bottom and by walls extending along the bottom and limiting the recess at least along three sides. It is particularly preferable and advantageous when the cavity in the side region is not limited by a wall in a direction toward the outer edge, i.e., the cavity is open toward the outer edge. Generally, the cavity in the side region is adapted to the gradual height reduction of this region.

It is particularly preferable and advantageous when there is provided more than 5.2 of the link members on each 5 cm of the reinforcing strip. With more of the link members per unit of length of the reinforcing strip, they can be made more slender and can be arranged more easily on the carrier band.

It is particularly preferable and advantageous, when the reinforcing strip is provided with two end members having each a width and a height tapering toward respective free ends of the end members, with the tapering of the height and/or the tapering of the width taking place along the entire length of the end members, and/or with the length of the end member exceeding the length of an adjacent link member at least by two times. The shape of an end member is selected so that an adequate gluing surface is obtained. The end member has a streamlined outer profile, and its weight is reduced. As a rule, the end member is provided with a cavity open at its outer surface, and has a continuous bottom surface for gluing the end member to the carrier band.

According to the present invention, there is further provided a reinforcing strip which in its free, release position, has a curved profile, with a ratio of an arcuate length of the reinforcing strip to a secant length of the reinforcing strip being greater than 1.1, and with adjacent link members having their stop surfaces pressed against each other under a preload in areas of the stop surfaces adjacent to the carrier band.

The free curved position of the reinforcing strip is better adapted to the curvature of the fingers in the loose position of the hand. This free position of the strip insures that in the non-free position of the strip, the link members abut each other with a miniscule clearance between the abutting each other stop surfaces of the respective link members. Rather, the link members are pressed against each other with a preload, while being firmly attached to the carrier band. With the curved shape of the reinforcing strip in its free position, the carrier band is also prestressed.

It is further preferable and advantageous when the reinforcing strip has channel extending through each of the link member between its bottom surface and the cavity, and a high-tensile core located in the channel and having its opposite ends secured to respective end members.

The core connects the link and the end members and insures a pivot connection between adjacent link members and between the end members and the respective adjacent link members. The core also insures that the link members retain their position in the bent position of the strip. Also, the core facilitates obtaining of the prestressed or preloaded bent position of the reinforcing strip.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS:

The drawings show:

FIG. 1 a plan view of a first embodiment of a reinforcing strip according to the present invention for a goalkeeper's glove and which is shown in its linear position;

FIG. 2 a side view of the reinforcing strip shown in FIG. 1 in its released curved position;

FIG. 3 a cross-sectional view along line III—III in FIG. 1 at an increased, in comparison with FIG. 1, scale;

FIG. 4 a plan view of a second embodiment of a reinforcing strip according to the present invention for a goalkeeper's glove and which is shown in its linear position; and FIG. 5 a cross-sectional view along line V—V in FIG. 4 at an increased, in comparison with FIG. 4 scale.

DETAILED DESCRIPTION OF THE PREFERRED EMBODIMENT

A reinforcing strip according to the present invention, which is shown in the drawings, has a carrier band 1, two end members 2, and link members 3 all of which are glued to the carrier band 1 with a glue layer 4. The reinforcing strip has, as shown in FIG. 2, an arcuate length 5 and a secant length 6. The carrier band 1 provides for a pivot connection 7 between two adjacent link members 3 at their connection or impact points and between an end member 2 and an adjacent link member at their connection or impact point. The adjacent link members 3 and each of the end members 2 and the adjacent thereto link member 3 have facing each other, stop surfaces 8. Each of the end members 2 and each of the link member 3 have an upper surface 9 and a lower or bottom surface 10.

There is provided, generally, more than 5.2 of the link members on each 5 cm of a length 22 of the reinforcing strip.

Each end member 2 and each link member 3 have a middle region 11 and a side region 12 and, further, two side outer edges 13 provided on opposite sides of a middle region a respective member. The height of the side regions gradually diminishes toward a respective outer edge. Each of the link members 3 has a cavity 14 open at the upper surface 9. The cavity 14 is divided by three longitudinal webs 15 in two middle cavity portions 16 and two outer cavity portions 17. Each of the end members 2 has two, opening toward the upper surface 9, cavity portions 18 which are likewise separated from each other by a longitudinal web and extend in the longitudinal direction of the reinforcing strip. Each end member 2 has a free end 19.

In the embodiment of a reinforcing strip according to the present invention, which is shown in FIGS. 4–5, there is provided a channel 20 that extends in the longitudinal direction of the reinforcing strip through each link member 3 and into each of the end members 2. With regard to its width, the channel 20 is provided only in the middle region 11 and is located between the bottom 10 and the middle cavity portion 16. A plastic, high-tensile core 21 is arranged in the channel 20. The core 21 is formed as a strip and is connected, at its opposite ends, with respective end members 2 by being glued thereto or with rivets. The link members 3 are capable of a limited displacement relative to the core 21.

Though the present invention was shown and described with references to the preferred embodiments, such are merely illustrative of the present invention and are not to be construed as a limitation thereof, and various modifications to the present invention will be apparent to those skilled in the art. It is, therefore, not intended that the present invention be limited to the disclosed embodiments or details thereof, and the present invention includes all of variations and/or alternative embodiments within the spirit and scope of the present invention as defined by the appended claims.

What is claimed is:

1. A reinforcing strip for a goalkeeper's glove, comprising a flexible, substantially high-tensile carrier bank; and a plurality of compression-proof link members supported on the carrier bank and arranged in a row one after another, wherein each two adjacent link members form a pivot connection with each other and have stop surfaces facing each other, extending transverse to the carrier band, and abutting each other in a stretched position of the reinforcing strip, wherein each of the link members has an upper surface remote from the carrier band, a cavity provided in a middle region of the link member and open at the upper surface, and a flat closed bottom surface glued to the carrier member with formation of a glue layer therebetween, and wherein each link member has two side regions located on opposite sides of the middle region, with a height of each of the side regions gradually diminishing toward a respective outer edge of a respective link member, and with each of the side regions having a cavity open at the upper surface.

2. A reinforcing strip as set forth in claim 1, wherein the cavity, which is formed in the middle region of each of the link members and the cavity of the side region are separated by a web extending in a longitudinal direction of the reinforcing strip.

3. A reinforcing strip as set forth in claim 1, wherein the cavity in each of the side regions is wall-free in a direction toward the respective outer edge.

4. A reinforcing strip as set forth in claim 1, wherein there is provided more than 5.2 of the link members on each 5 cm of a length of the reinforcing strip.

5. A reinforcing strip as set forth in claim 1, further comprising two end members each having a width and a height which taper toward a free end of the end surface.

6. A reinforcing strip as set forth in claim 5, wherein at least one of a tapering of the end member width and a tapering of the end member height takes place along an entire length of the end member.

7. A reinforcing strip as set forth in claim 5, wherein the end member has a length at least double of a length of the adjacent link member.

8. A reinforcing strip as set forth in claim 1, wherein in a free curved position of the reinforcing strip, a ratio of an accurate length of the reinforcing strip to a secant length of the reinforcing strip is greater than 1.1, and adjacent link members have their stop surfaces pressed against each other under a preload in areas of the stop surfaces adjacent to the carrier band.

9. A reinforcing strip as set forth in claim 1, further comprising a channel extending through each of the link members between the bottom surface thereof and the cavity, and a high-tensile core located in the channel and having opposite ends thereof secured to the respective end members.

* * * * *